US007534288B2

(12) United States Patent
Bromberg

(10) Patent No.: US 7,534,288 B2
(45) Date of Patent: May 19, 2009

(54) HIGH PERFORMANCE ELECTROSTATIC PRECIPITATOR

(75) Inventor: Leslie Bromberg, Sharon, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 114 days.

(21) Appl. No.: 11/399,868

(22) Filed: Apr. 7, 2006

(65) Prior Publication Data

US 2007/0234905 A1 Oct. 11, 2007

(51) Int. Cl.
*B03C 3/66* (2006.01)

(52) U.S. Cl. ..... 96/54; 96/60; 96/63; 96/80; 96/96

(58) Field of Classification Search ..... 96/54, 96/60, 62, 63, 80.96; 95/79–81, 78
See application file for complete search history.

(56) References Cited

U.S. PATENT DOCUMENTS 3,496,701 A * 2/1970 Owe ..... 95/80
3,518,462 A * 6/1970 Brown ..... 310/10
4,726,812 A * 2/1988 Hirth ..... 95/80
4,765,803 A * 8/1988 Hirth ..... 95/80
4,941,962 A * 7/1990 Inoue ..... 204/639
4,972,957 A 11/1990 Liu et al.
5,420,424 A * 5/1995 Carnahan et al. ..... 250/287
5,439,513 A * 8/1995 Periasamy et al. ..... 96/25
5,547,493 A * 8/1996 Krigmont ..... 96/54
5,593,560 A * 1/1997 Inoue ..... 204/671
5,655,210 A * 8/1997 Gregoire et al. ..... 422/186
5,695,549 A * 12/1997 Feldman et al. ..... 96/55
5,707,428 A * 1/1998 Feldman et al. ..... 96/54
5,892,141 A 4/1999 Jones et al.
5,914,454 A 6/1999 Imbaro et al.
6,461,405 B2 * 10/2002 Reyes ..... 95/7
6,585,803 B1 7/2003 Chang et al.
7,122,070 B1 * 10/2006 Krichtafovitch ..... 95/2
7,300,493 B2 * 11/2007 Kim et al. ..... 95/2

OTHER PUBLICATIONS

Robinson, Myron, "Electrostatic Precipitation," in Air Pollution Control, Part 1, Werner Straus ed., Wiley Interscience, (1971) pp. 227-335.
Mainelisa, G. et al., "Collection of airborne microorganisms by a new electrostatic precipitator," Aersol Science, vol. 33 (2002) pp. 1417-1432.
Volckens, J. and Leith, D. "Electrostatic sampler for semivolatile aerosols: chemical artifacts," Environ. Sci. Technol., vol. 36 (2002) pp. 4608-4612.
Buryakov, I.A., et al., "A new method of separation of multi-atomic ions by mobility at atmospheric pressure using a high-frequency amplitude-asymmetric strong electric field," Int. J. Mass Spectrom. Ion Processes, vol. 128 (1993) p. 143-148.

* cited by examiner

*Primary Examiner*—Richard L Chiesa
(74) *Attorney, Agent, or Firm*—Sam Pasternack; Choate, Hall & Stewart, LLP

(57) ABSTRACT

Electrostatic system is for optimal charging of aerosols and particulates. In order to improve their collection, the system uses a combination of DC field and AC fields produced by multiple AC electrodes. The system minimizes the size and power consumption of the device, as well as increasing the collection efficiency.

19 Claims, 5 Drawing Sheets

(a)

(b)

(a)

(b)

(a)

(b)

HIGH PERFORMANCE ELECTROSTATIC PRECIPITATOR

BACKGROUND OF THE INVENTION

This invention relates to a high performance electrostatic precipitator and more particularly to an electrical system for charging particulates or aerosols in a charging stage of an electrostatic precipitator.

The use of electrostatic precipitators for the collection of particulates is in common practice in industrial settings. These devices have adequate removal efficiency of small particulates, down to 0.1 μm (about 99.9%). They are large and require substantial power. More recently, small scale electrostatic precipitators have been introduced for residential use.

In the United States electrostatic precipitators have had competition from bag houses for the treatment of power plant particulate matter (PM). Bag house units have lower cost of ownership than the electrostatic precipitators (lower capital cost and comparable operating costs), while in Europe for historical reasons electrostatic precipitators are still dominant.

One way to differentiate electrostatic precipitators is whether they use single or two stage precipitators. In a single stage precipitator, both the charging of the particulates and their removal occurs in the same region of the electrostatic precipitator. In the two-stage configuration, charging of the particulates occurs at a different location from their removal.

The use of two stage electrostatic precipitators is found in the literature. See, for example, Myron Robinson in *Air Pollution Control*, part 1, "Electrostatic Precipitation," Werner Straus ed., Wiley Interscience pp. 227-335 (1971). The contents of this reference are incorporated herein by reference. The advantage of these devices is that particulate charging in the first stage can be separated from particulate collection in the second stage. Thus each stage can be independently optimized. The charging stage is usually small compared with the collection stage.

The charging stage includes a corona generating element with one polarity, producing ions into a gas stream that drift towards an oppositely charged electrode. Positive corona is preferred in some applications, primarily indoor air cleaning, because of minimization of the production of ozone (important when the clean air is to be used for breathing), but either positive or negative corona can be used.

In order to remove a high fraction of the particulates, it is best if the particulates are charged to the highest level. The drift speed of the particulates in the collection region depends linearly on the charge of the particulates. For particulates >0.2 μm, the particulates charging mechanism is by ion bombardment, which ceases when the local electric fields due to the charges in the particulate oppose the charging electric field, and thus stops the charging process. In this particulate size range the charge in the particulates increases linearly with applied electric field, and thus high electric field in the charging section is as important as high electric field in the collection section.

There are two concerns with the use of conventional electrostatic precipitators. The first one is power requirement and the second is specific volume (size required for accomplishing sufficient PM removal). In addition, for residential use, the production of ozone needs to be minimized.

SUMMARY OF THE INVENTION

In one aspect, the system for charging particulates or aerosols according to the invention includes a corona electrode spaced apart from an outer electrode forming a gap therebetween. Circuitry is provided for establishing a DC field in the gap, the DC field having a strength selected both to generate ions and to move the ions across the gap. At least one non-ion-emitting AC electrode is disposed in the gap to generate high frequency AC electric fields in the gap. In a preferred embodiment, the fields charge the particulates or aerosols to a high charge state. It is preferred that the at least one AC electrode have a DC bias to minimize ion collection by the AC electrodes.

In yet another embodiment, the invention further includes circuitry to generate symmetric electric potential waveforms applied to the at least one AC electrode. In another preferred embodiment, circuitry generates asymmetric electric potential waveforms applied to the AC electrodes. Multiple sets of AC electrodes may be provided and driven by different waveforms.

In yet another aspect, the invention is an electrostatic precipitator including a charging stage having a corona electrode spaced apart from an outer electrode forming a gap therebetween and circuitry for establishing a DC field in the gap. The DC field has a strength selected both to generate ions and to move the ions across the gap. At least one non-ion-emitting AC electrode is disposed in the gap to generate high frequency AC electric fields in the gap. A collection stage is provided for collecting the particulates or aerosols charged in the charging stage. The collecting stage includes apparatus to collect the particulates or aerosols.

In preferred embodiments, the system may include the corona electrode and the outer electrode in a wire-in-tube electrostatic precipitator configuration. In another embodiment, the corona electrode and the outer electrode form a wire-to-plane electrostatic precipitator.

The system of the invention may be used to clean dust from indoor air with a low production of ozone. The system may also be used advantageously for collection of aerosols with high efficiency for environmental sampling.

By employing AC electrodes, the precipitator of the invention increases the average charge in the particulates by a substantial factor and increases the efficiency of the charging process to decrease power consumption.

BRIEF DESCRIPTION OF THE DRAWING

The invention is described with reference to the several figures of the drawing, in which.

DETAILED DESCRIPTION OF CERTAIN PREFERRED EMBODIMENTS

Embodiments of the present invention address several of the shortcomings of conventional electrostatic precipitators. These embodiments involve the use of AC fields in addition to DC fields in any part of the process in electrostatic precipitators where the particulates are being charged. Particulate charging takes place in the first stage of two-stage electrostatic precipitators, or throughout the region of a single stage electrostatic precipitator.

The use of the precipitators according to the invention can increase by one to two orders of magnitude the particle drifts in the collection region due to the large charge in particulates due to the application of the novel technology. At the same time, the power consumption and the production of hazardous substances, like ozone, is decreased. The disclosed precipitator uses AC fields in conjunction to DC fields to:

a) Increase the average charge in the particulates by a substantial factor b) Increase the efficiency of charging to decrease power consumption.

For the collection region, once the particulates have been charged to a high state, the optimal collection is through a laminar device, in that the collection reaches practically 100% in a finite distance as opposed to the usual case in precipitators with turbulence that moves the particulates in a random motion and a collection which is exponential with length (which give rise to the Deutch's equation for removal efficiency in conventional electrostatic precipitators). See, M. Robinson cited above.

Figure 1:
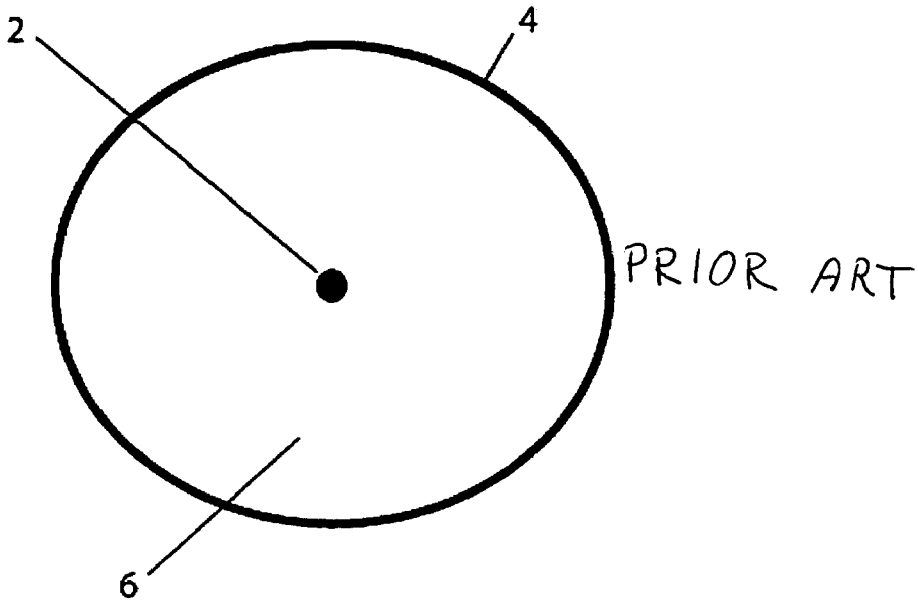
FIG. 1*a* is a schematic diagram of a conventional prior art wire-in-tube electrostatic precipitator.
FIG. 1*b* is a schematic diagram of a high performance wire-in-tube electrostatic precipitator according to one embodiment of the invention.
Figure 1:
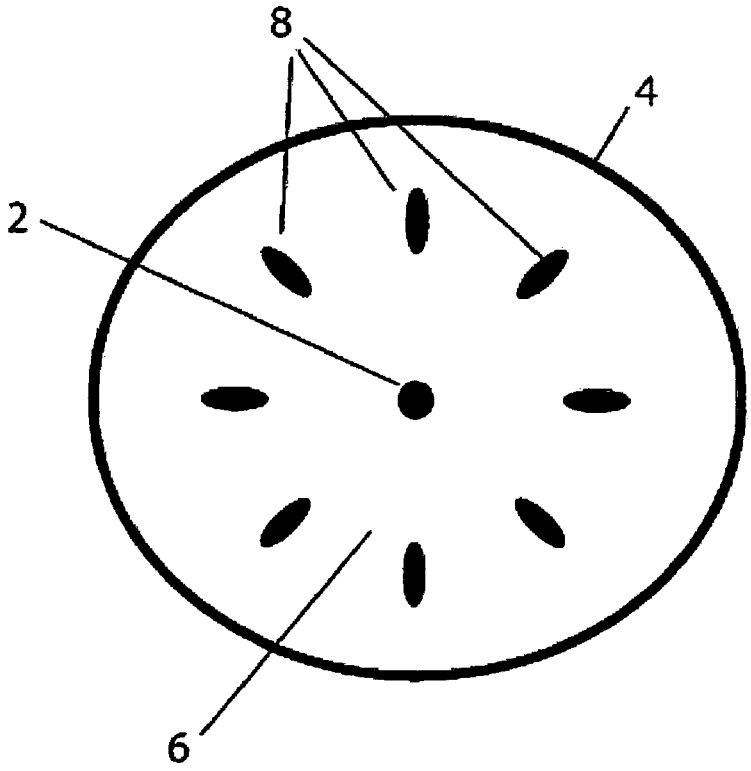

To illustrate the charging concept of an embodiment of the High Performance Electrostatic Precipitator of the invention, FIG. 1 shows a comparison between (a) a conventional charging stage and (b) the charging stage in the High Performance Electrostatic Precipitator disclosed herein. FIG. 1*a* is a prior art wire-in-tube precipitator. A corona electrode 2 is surrounded by outer electrode 4 creating an interelectrode gap 6. A high potential difference is applied between the corona electrode 2 and the outer electrode 4. Ions of the same polarity as the corona electrode 2 are generated at the corona electrode 2 or in its neighborhood and drift radially outwardly towards the outer electrode 4 through the gap 6. In the conventional design of FIG. 1*a*, the electric field is low in the bulk of the stage, as the electric field decreases as 1/r (r is the radius). Even though the electric field is high, on the order of 30 kV/cm in the corona region near corona electrode 2, it is on the order of 1-2 kV/cm in the charging region. The maximum charge in the particulates is proportional to the value of the unperturbed electric field, as the particulate stops charging when the charge of the particulate $Q_{max}$ is $$Q_{max} \sim 4\pi\epsilon_0 p a^2 E_0$$

where p is related to the permittivity of the particles and that of air, a is the particulate radius, and $E_0$ is the value of the unperturbed electric field. This affects the performance of the precipitator, as the maximum charge on the particulate, for particles >0.2 μm, is linearly dependent on the value of the electric field. See, for example, Robinson page 264. The low value of the electric field in the bulk of the conventional precipitator results in low charging of the particulates.

FIG. 1*b* shows the High Performance Precipitator charging section of one embodiment of the invention. There are additional AC electrodes 8 located between the corona electrode 2 and the outer electrode 4 that provide high frequency, high voltage AC fields. It is important that the AC electrodes 8 do not experience corona, that is, that ions not be generated in the regions close to the AC electrodes 8. Because of the high frequency of the AC field, the average ion motion is, to zeroth order, unperturbed by the AC fields, and the average motion of the ions follows only the DC fields. However, because of the presence of the high AC fields generated by applying AC voltages to AC electrodes 8, the charging of the particulates can reach a much higher state in this case, by as much as a factor of 15 (if the AC field has a value of 15 kV/cm, while the DC field in this region is only about 0.75 kV/cm).

By illustration, a conventional electrostatic precipitator would have a 35 kV DC potential applied to the corona electrode 2, so for a 1 mm radius the DC field is 75 kV/cm in the region near corona electrode 2, but the value of the field is about 1 kV/cm at a radius of 70 mm in the interelectrode gap 6. An illustrative AC electrode high performance electrostatic precipitator would have AC fields on the order of 5-15 kV/cm at 70 mm, about an order of magnitude higher. In the High Performance Electrostatic Precipitator disclosed herein the potential of the DC field, and thus the electric field, may be reduced substantially from that of the conventional precipitator, resulting in a even larger ratio between AC and DC fields.

Figure 3:
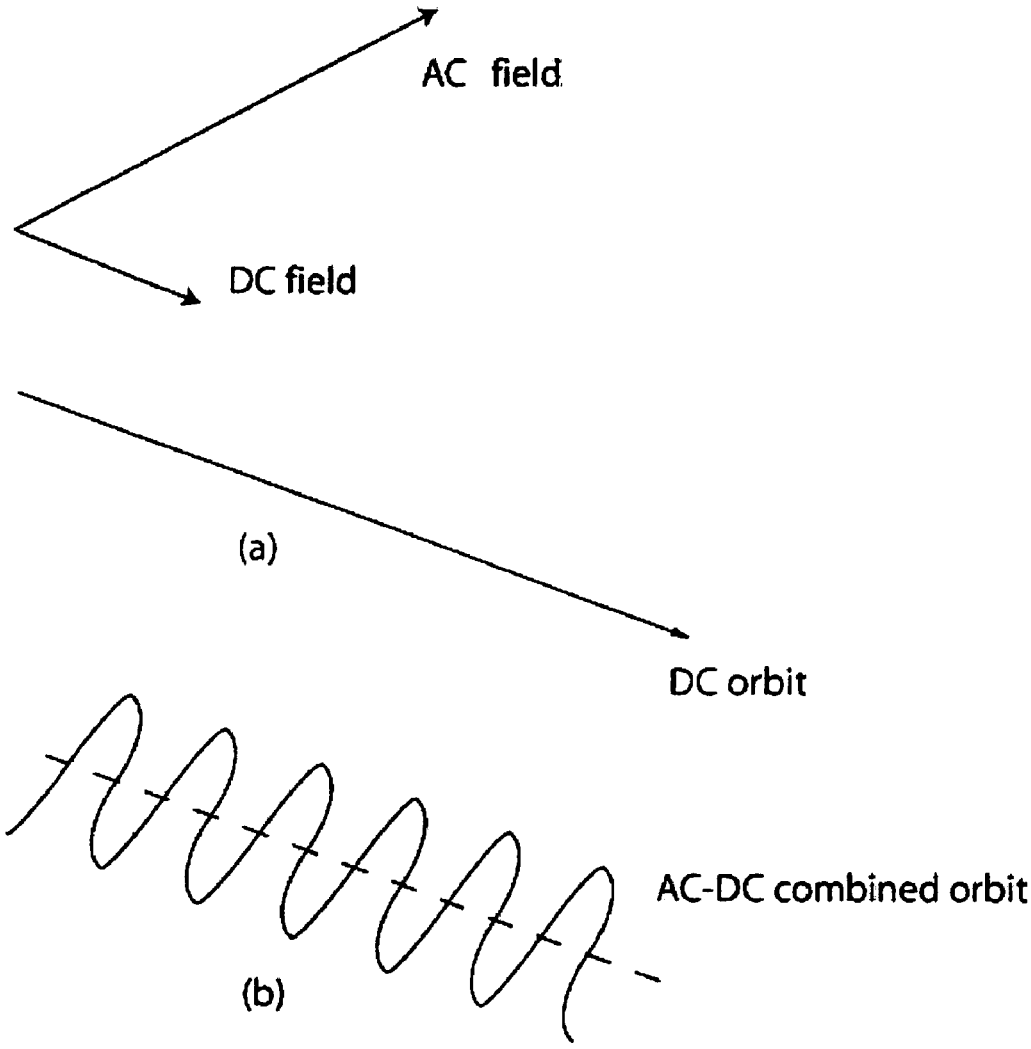
FIG. 3*a* is a schematic illustration showing ion motion as a result of DC drift only.
FIG. 3*b* is a schematic illustration of ion motion as a result of AC and DC drift combined.

There is a second major advantage of the use of the AC fields generated by the AC electrodes 8. The chances of an ion striking a particulate and charging it is proportional to the length of the track that the ion makes. In the case of the conventional charging stage FIG. 1*a*, the length of the ion track is approximately the radius of outer electrode 4, while in the case of the AC field it is increased by the ratio of the AC to DC fields, which can be a factor of 20 or more. Ions in the presence of the AC and DC field will have an average path similar to that imposed by the DC field, but with drifts that can be both perpendicular or aligned with the DC motion. These drifts result in excursion of the ion from the ion orbit resulting from the DC field. The DC drift and the combined AC and DC drifts are indicated in FIGS. 3*a* and 3*b*. Since the velocities are proportional to the fields (in low field approximation), the ratio of the length of the ion path due to the AC fields to the length of the ion path due to the DC fields is proportional to the ratio of the AC field to the DC field. This ratio needs to be averaged over the ion path, and interestingly, is independent of the frequency of the AC field. Thus, because the ion orbit is much longer, the ion utilization is much higher, and the current needed to charge the particulates can be decreased by large factors. The AC field can result in excursions from the orbit due to only the DC field both in the direction along the DC field as well as the direction normal to the DC field.

The power can be decreased even more, as the charging is dependent on the value of the AC field, not the DC field, and thus the DC voltage can be further reduced. If the voltage is reduced by a factor of 5, then the power in a High Performance Electrostatic Precipitator can be decreased by a factor of 100. It would be necessary to redesign the corona electrode, mainly by making the radius smaller, in order to achieve electric fields that result in corona at the reduced corona electrode potential. The smaller radius results in smaller ion currents.

It should be noted that the configuration shown in FIG. 1*b* is illustrative, and the shape, location and number of AC electrodes 8 can be changed to optimize the system characteristics. It is important that there be high electric field throughout most of the interelectrode gap 6, as well as the fact that it is populated with ions. There are geometries, as will be mentioned below in describing FIGS. 2(*a*) and 2(*b*) that although there is high electric field, their ion number density is small, and thus little particulate charging will take place here. Although obvious, it should be mentioned that uncharged particulate will not be collected. It is important that there be either relatively uniform ionization, or that there be sufficient turbulence so that the particulates experience charging at different locations in the cross section of the charging section, in order to promote charging of the particulates. It should be pointed out that if it is necessary to depend on turbulence, the device may have to be longer (and thus consume more power), as the charging of the particulates is stochastic (several mixing lengths in order to promote particulate charging).

It is important to avoid bypass regions with no ions or regions of low electric field. The geometry shown in FIG. 1(*b*) has these attractive characteristics.

The preferred potential applied to the corona electrode 2 is DC. The waveform of the AC fields is described next. To minimize ion collection in the AC electrodes 8, it is necessary to apply a bias DC voltage to the AC electrodes. The bias voltage of the AC electrode should be comparable to the DC potential at the location of the AC electrodes 8. The value of the DC bias can be varied to optimize the performance of the High Performance Electrostatic Precipitator. If the DC potential of AC electrode 8 is slightly closer to that of the corona electrode than the ambient DC field in the absence of the AC electrodes, the ion current collected by the AC electrodes decreases. The configuration is thus similar to a triode circuit.

The DC bias of the AC electrodes 8 should be adjusted in order to optimize the performance of the precipitator; the optimization involves both increasing the particulate removal and minimizing the required power. For symmetrical applications, the DC bias may be uniform, while for asymmetrical AC electrodes 8 the DC bias may be non-uniform. In principle, it is possible to provide a DC bias to each AC electrode 8 independently to optimize the performance.

Figure 4:
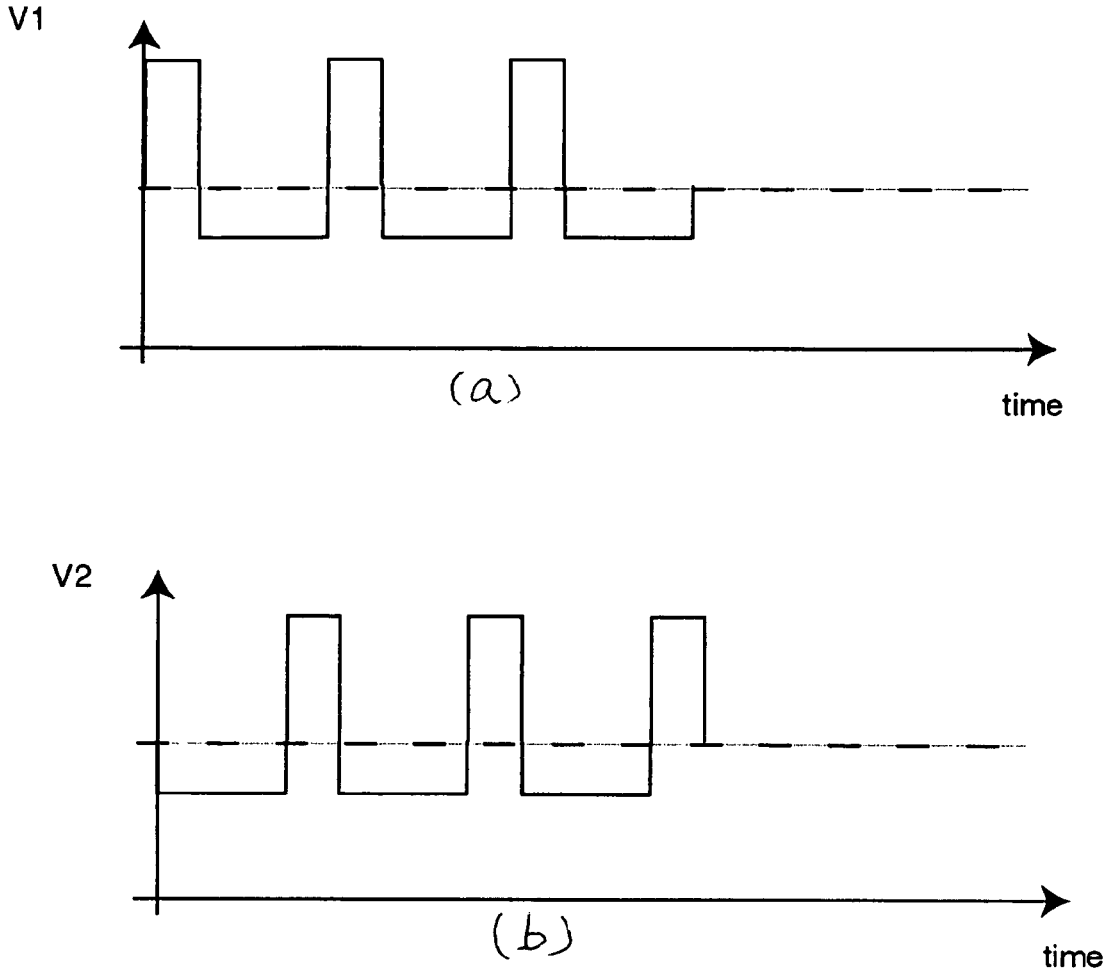
FIGS. 4*a* and 4*b* are waveforms that may be used to energize the AC electrodes according to an embodiment of the invention.

The potential waveforms of the AC electrodes 8 can be square wave, sinusoidal or any other shape. In addition, they can have different phases. FIG. 4 illustrates the case of using two waveforms to drive different sets of electrodes. By energizing the AC electrodes with different waveforms it is possible to generate high electric fields in regions where otherwise, by symmetry, the fields would be low. FIGS. 4*a* and 4*b* show illustrative waveforms, where some of the AC electrodes 8 are energized with a V1 waveform, while the adjacent AC electrodes 8 are energized with a V2 waveform which is similar to that of the V1 waveform but with a phase shift. Note that in this case the DC bias of both sets of electrodes is the same. Higher electric fields throughout the interelectrode gap 6 can be obtained by the use of multiple waveforms, although with increased complexity of the electrical system. The phase shift between potential waveform V1 and potential waveform V2 is adjusted to optimize the system. Although only two different waveforms are illustrated, the innovation does not exclude the use of a larger number of waveforms.

In addition, it is possible to make the waveform asymmetric. Asymmetric waveforms are illustrated in FIGS. 4*a* and 4*b*. In asymmetric waveforms the duration of the positive and negative parts of the AC voltage are different. Thus, the imposed positive AC voltage is higher than the negative imposed AC voltage, or the imposed negative AC voltage is higher than the positive imposed AC voltage.

Non-uniform AC waveforms at high electric fields have been shown to result in net drifts. This effect is due to the changes of the ion mobility at high electric fields. The principle is used in FAIMS devices. See, Carnahan, Byron L and A. S. Tarassov, *Ion Mobility Spectrometer*, U.S. Pat. No. 5,420,424 (1995). In this application, the non-uniform fields are used to minimize the collection of ions by the AC electrodes 8, but assuring that the net drift due to the field asymmetry is away from the AC electrodes 8.

The frequency of the AC potential is determined by the size of the ion drifts. Higher frequencies result in smaller, but more frequent excursions. It is important to minimize the excursion, in particular to prevent excursions that will drive the ions into the AC electrodes 8 (which would reduce the ion utilization). Thus high frequencies are desired. Frequencies on the order of 20 kHz to hundreds of kHz are desired.

It should be stressed that one goal of the design of the electrical system and AC electrode 8 geometry is to minimize the collection of ions by these electrodes, thus minimizing the power required at these frequencies.

Multiple charging stages can be envisioned in multiple stage electrostatic precipitators. Under these circumstances, different size particulates can be retrieved in different collection stages, separated by charging stages optimized for the size distribution and particulate loading of that stage. The problem of space charge buildup for high particulate loadings of the gas can be minimized. In addition, the multiple stage embodiment has the advantage of providing more uniform loading along the collection electrode.

Although the corona electrode 2 has been described as a DC field, low frequency AC fields can be used especially if multiple charging stages exist and the residence time of the ion in the charging stage is shorter than the period of the AC field, so the particulates experience unipolar charging during the transit through the charging stage.

Because of the high level of charging of the particulates, the drifts in the collection region will be large, and thus high concentration of particulate matter will be deposited in the front end of the collection region. Decreased fields could be used to obtain a more uniform distribution of collected particulate matter. Alternatively, more frequent rapping of the collecting electrode could be used.

The high degree of charging of the particulates results in high charge in the particulate matter cake layer. Care must be taken to prevent dislodging the collected cake layer because of electrostatic repulsion. This can be avoided by more frequent rapping of the collecting electrode. However, since most of the charging of the cake layer is due to direct ion bombardment (from those ions that do not strike a particulate), the fact that the High Performance Electrostatic Precipitator reduces the ion current required decreases substantially the problem of high charging of the cake layer. Thus the problem of back-corona (when enough charge has collected on the cake layer on the collection electrode so that an opposite polarity corona is developed on the collection electrode) is reduced.

In addition, by minimizing the discharge current required to charge the particulate matter, undesired chemistry can be avoided. This is the case when the flow has a large concentration of chlorinated or sulfur-containing compounds, which in the presence of water and a corona discharge could generate aggressive acids capable to corroding the electrodes.

Figure 2:
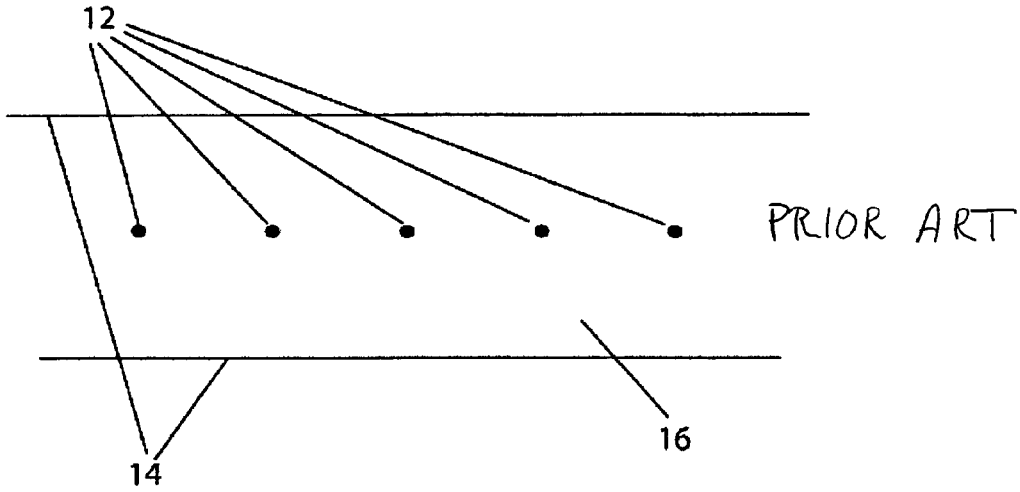
FIG. 2*a* is a schematic diagram of a conventional prior art wire-to-plane electrostatic precipitator.
FIG. 2*b* is a schematic diagram of a high performance wire-to-plane electrostatic precipitator according to an embodiment of the invention.
Figure 2:
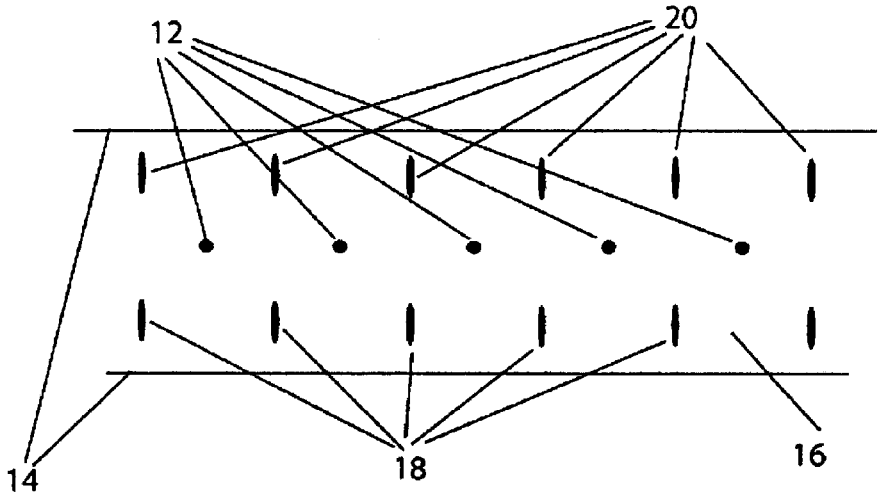

The previous discussion has concentrated on the tubular geometry shown in FIGS. 1(*a*) and 1(*b*). A popular type of prior art electrostatic precipitator is shown in FIG. 2(*a*), known as wire-to-plate. The high performance precipitator disclosed herein can also be applied to this geometry. The ions travel from corona electrode 12 to outer electrode 14 through interelectrode gap 16. By the use of AC electrodes 18 and AC electrodes 20, the electric field over the bulk of the device can be increased substantially in the regions away from the corona electrode 12, increasing the maximum charge that can be injected into the particulate. In addition, the length of the ion orbit is increased substantially, as in the case of the tubular geometry shown in FIG. 1(*b*). Thus, the fraction of the ions that are used to charge particulates is increased by a large factor, as in the case of the tubular geometry.

One difficulty with the use of wire-to-plane geometry is that there are regions, specifically on the plane that contains the corona electrodes, half-way from the electrodes, where there are very few ions in the case when the corona electrodes 12 are at the same potential. In this case, even if the electric fields can be increased in this region, the particulates that travel down this region of the charging stage will not be charged, as there are no ions. In this case, it is necessary to depend upon turbulence to move the particulates across the cross section of the charging stage shown in FIG. 2(*b*).

One possible way to remedy this situation is the location of electrodes near the plane of the corona electrodes, at the same potential, or similar potential, as the outer electrode. Thus some of the ions will be directed towards the region in-between the corona electrodes, filling the interelectrode gap more uniformly with ions.

As in the case of the tubular geometry of FIGS. 1*a* and 1*b*, the waveform of the electrodes and the DC bias of the AC electrodes 18 and 20 can be adjusted for optimal performance of the charging stage, using multiple waveforms and DC biases. Although the geometry shown in FIG. 2*b* shows the same periodicity of AC electrodes 18 and 20 as the periodicity of the corona electrodes 12, this is only for illustrative purposes, and different periodicity can be used. Also, the location and shape of the AC electrodes 18 and 20 are for illustrative purposes only.

In addition to charging the particulates, the use of an AC field can help in the collection process (through agglomeration). Configurations have been investigated where there are particulates of both charges generated, for example, but with charging of a fraction of a particulate-ladden gaseous stream with one polarity and the remaining portion of the stream charged of the opposite polarity. The collection can be improved by having large aerosols, which have a large electric drift speed, move in an oscillatory motion by the presence of strong AC fields through the gas with collection of the smaller aerosols of the opposite charge by impaction (aided by electrostatic attraction between the opposite charge large aerosol and small aerosol). This embodiment is most attractive when the full stream contains charge of one polarity, and a second stream of large charge aerosols is introduced. The second stream can consist of charged water droplets. It is important to assure that the electrical charge of the second aerosol stream is not reduced substantially, in order to assure ease of collection in subsequent stages. Thus, the method works best after the larger particulates of the particulate-laden stream have been removed, followed by agglomeration of the smaller particulates on the aerosols from the second stream. This avoids large reduction of charge in the aerosols of the second stream.

The geometries would be similar to those of FIGS. 1*b* and 2*b*, but without the corona electrode, and without the presence of the DC field. Collection of the agglomerated particulates will be achieved in a downstream precipitator, but since the aerosols have large drift velocities, the collection is improved.

Although the discussions have described applications to particulate matter, the concept works similarly for aerosols and is not limited to solid matter.

The discussions above are pertinent to the collection of particulate matter from industrial exhausts, such as power plants, cement kilns, and other industrial exhaust with large flow rates. The invention can also be used in small applications, such as indoor air cleaning (residential or commercial). For this application, the use of reduced ion current is important in order to minimize the generation of hazardous substances, such as ozone, which occur in the corona region. Reduced current is another advantage of the high performance electrostatic precipitator disclosed herein, in addition to low power consumption and small size.

A different application of the high performance electrostatic precipitator is in environmental sample collection, either for assuring conformance to work-place requirements or for use in threat control and prevention. An example of the latter application is a system for collecting biological aerosols, for which high performance electrostatic precipitator technology could be implemented in a small size with very high collection efficiency.

Figure 5:
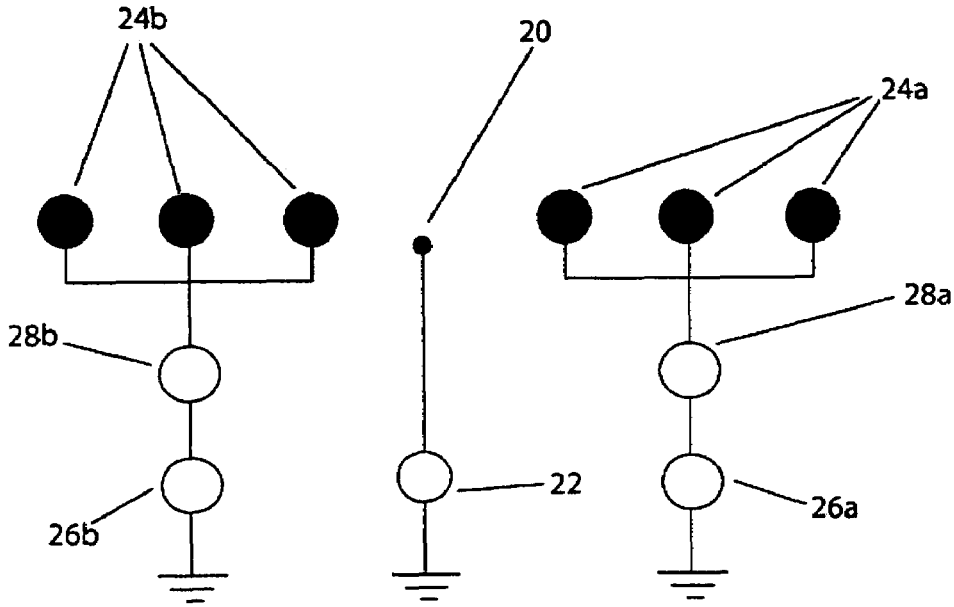
FIGS. 5*a* and 5*b* are circuit diagrams of power supplies suitable for use with embodiments of the invention.
Figure 5:
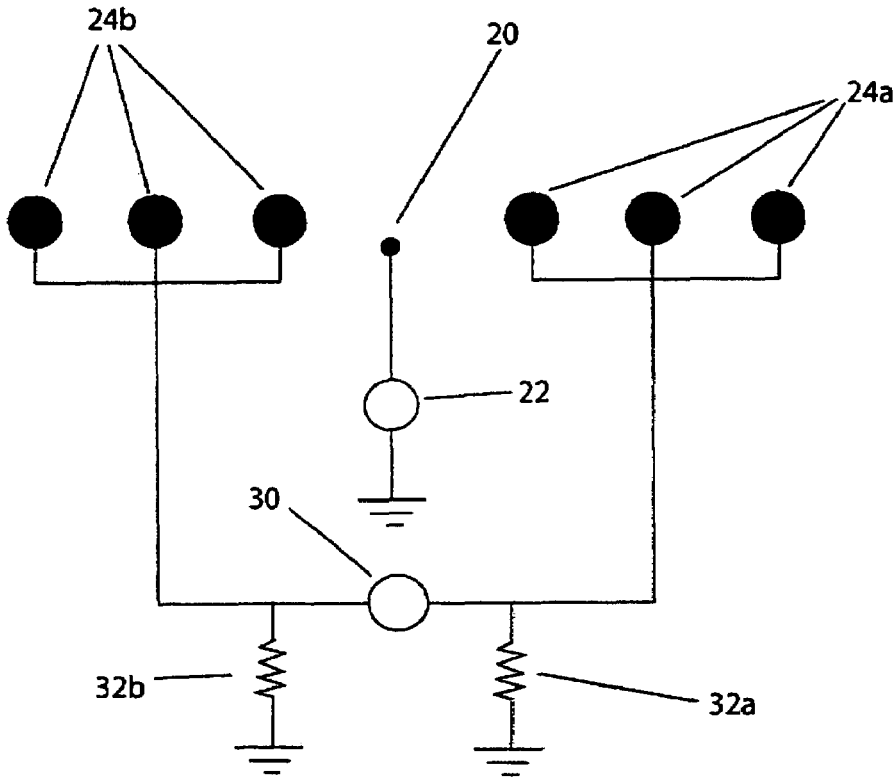

Power supply geometries and interconnection to the AC electrodes are shown in FIGS. 5*a* and 5*b*. Corona electrode 20 is energized by a power supply 22. Sets of AC electrodes 24*a* are energized by an AC power supply 28*a* that sits on top of a DC bias power supply 26*a*. Another set of AC electrodes 24*b* is energized by an AC power supply 28*b* that sits on top of a DC bias power supply 26*b*. It is possible to combine DC power supplies 26*a* and 26*b* into a single power supply if desired. Power supplies 28*a* and 26*b* generate AC potentials that can be either symmetric or asymmetric or capable of generating both. FIG. 5*a* shows sets of AC electrodes that have a different potential waveform fed from different power supplies, while the set of AC electrodes that share the same potential waveform share the power supply. The electrical system for each AC electrode set that shares the same potential waveform has an AC component on top of a DC bias, as shown in 5*a*.

Alternatively, it is possible to feed the different sets of electrodes 24*a* and 24*b* as shown in FIG. 5*b*, with a single high voltage AC power supply 30 feeding both sets of electrodes. In this case, the common mode potential of the system will increase until the voltage is such that neither electrode can accommodate any more ions, resulting in modification of the DC bias in the interelectrode gap to the point where very few ions are emitted from the corona wire 20. In order to discharge the common mode bias of the AC electrodes, FIG. 5*b* shows a set of resistive elements 32*a* and 32*b*. Alternative means of discharge could be devised, such as a spark gap on one of the legs.

The reader may refer to G. Mainelisa, A. Adhikarib, K. Willekeb, S. A. Leeb, T. Reponen, S. A. Grinshpun, "Collection of airborne microorganisms by a new electrostatic precipitator," *Aerosol Science* 33 1417-1432 (2002); and J. Volckens and D. Leith, "Electrostatic Sampler for Semivolatile Aerosols: Chemical Artifacts," *Environ. Sci. Technol.* 36 4608-4612 (2002) for additional information concerning electrostatic precipitators. The contents of these articles are incorporated herein by reference.

While particular embodiments of the invention have been shown and described, it will be obvious to those skilled in the art that various changes and modifications may be made without departing from the present invention in its broader aspects. It is intended that all matter contained in the above description and shown in the accompanying drawings shall be interpreted as illustrative and not in a limiting sense.

What is claimed is:

1. System for charging particulates or aerosols comprising:

a corona electrode spaced apart from an outer electrode forming a gap therebetween;

circuitry for establishing a DC field in the gap, the DC field having a strength selected both to generate ions and to move the ions across the gap; and at least one non-ion-emitting AC electrode disposed in the gap to generate high frequency AC electric fields in the gap.

2. The system of claim 1 wherein the fields charge the particulates or aerosols to a high charge state.

3. The system of claim 1 wherein the at least one AC electrode has a DC bias to minimize ion collection by the AC electrode.

4. The system of claim 1 further including circuitry to generate symmetric electric potential waveforms applied to the at least one AC electrode.

5. The system of claim 1 further including circuitry to generate asymmetric electric potential waveforms applied to the at least one AC electrode.

6. The system of claim 4 or claim 5 further including multiple sets of AC electrodes driven by different waveforms.

7. The system of claim 1 further including means to collect the particulates or aerosols.

8. The system of claim 1 used to clean dust from indoor air with low production of ozone.

9. The system of claim 1 used for collection of aerosols with high efficiency for environmental sampling.

10. The system of claim 1 wherein the corona electrode and the outer electrode form a wire-in-tube electrostatic precipitator.

11. The system of claim 1 wherein the corona electrode and the outer electrode form a wire-to-plane electrostatic precipitator.

12. Electrostatic precipitator comprising:

a charging stage having a corona electrode spaced apart from an outer electrode forming a gap therebetween;

circuitry for establishing a DC field in the gap, the DC field having a strength selected both to generate ions and to move the ions across the gap;

at least one non-ion-emitting AC electrode disposed in the gap to generate high frequency AC electric fields in the gap; and a collection stage for collecting the particulates or aerosols charged in the charging stage.

13. The electrostatic precipitator of claim 12 further including multiple charging stages each followed by a collection stage.

14. System for agglomerating particulates or aerosols comprising:

a first particulate laden stream charged to a polarity;

a second particulate laden stream charged to the opposite polarity;

at least one non-ion-emitting AC electrode disposed to generate a high frequency AC electric field, the field having a strength selected to move large aerosols in the first and second streams across a volume while minimizing collection on the at least one electrode, the motion of large particulates agglomerating smaller opposite charged particulates.

15. The system of claim 14 where the first and second particulate laden streams come from a same particulate laden source.

16. The system of claim 14 where the first stream comprises an entire particulate-laden stream, and the second stream comprises large particulates generated and introduced into the first stream for the explicit purpose of agglomerating the particulates of the first particulate-laden stream.

17. The system of claim 14 where the particulates of the second stream are droplets of water.

18. The system of claim 14 wherein an agglomeration stage is followed by a collection stage, collection aided by the fact that the particulates of the second stream are easily collectable.

19. The system of claim 16 wherein the electrical charge of the second stream is not reduced substantially.

* * * * *